US008448297B2

(12) United States Patent
Chen

(10) Patent No.: US 8,448,297 B2
(45) Date of Patent: May 28, 2013

(54) TORQUE-ADJUSTABLE HINGE

(75) Inventor: Ching-Yao Chen, Kueishan Hsiang (TW)

(73) Assignee: Yuan Deng Metals Industrial Co., Ltd., Taoyuan (TW)

( * ) Notice: Subject to any disclaimer, the term of this patent is extended or adjusted under 35 U.S.C. 154(b) by 431 days.

(21) Appl. No.: 12/825,260

(22) Filed: Jun. 28, 2010

(65) Prior Publication Data

US 2011/0314636 A1 Dec. 29, 2011

(51) Int. Cl.
*E05C 17/64* (2006.01)

(52) U.S. Cl.
USPC ..... 16/342

(58) Field of Classification Search
USPC ..... 16/75, 234, 319, 330, 342, 386, 390, 16/392
See application file for complete search history.

(56) References Cited

U.S. PATENT DOCUMENTS

| | | | | | |
|---|---|---|---|---|---|
| 5,697,125 | A * | 12/1997 | Gannon | ..... | 16/342 |
| 5,896,622 | A * | 4/1999 | Lu | ..... | 16/342 |
| 6,170,120 | B1 * | 1/2001 | Lu | ..... | 16/342 |
| 6,230,365 | B1 * | 5/2001 | Lu | ..... | 16/342 |
| 6,301,748 | B1 * | 10/2001 | Su-Man | ..... | 16/342 |
| 6,467,129 | B1 * | 10/2002 | Bae | ..... | 16/342 |
| 6,928,700 | B2 * | 8/2005 | Huong | ..... | 16/342 |
| 7,124,473 | B2 * | 10/2006 | Lu et al. | ..... | 16/342 |
| 7,451,522 | B2 * | 11/2008 | Lu et al. | ..... | 16/342 |
| 7,451,523 | B2 * | 11/2008 | Chen | ..... | 16/342 |
| 7,607,202 | B1 * | 10/2009 | Lee | ..... | 16/342 |
| 8,245,356 | B2 * | 8/2012 | Chu et al. | ..... | 16/342 |
| 2002/0162192 | A1 * | 11/2002 | Su-Man | ..... | 16/337 |
| 2003/0046793 | A1 * | 3/2003 | Novin et al. | ..... | 16/342 |
| 2007/0101543 | A1 * | 5/2007 | Lu et al. | ..... | 16/342 |

* cited by examiner

*Primary Examiner* — Roberta Delisle

(57) ABSTRACT

A hinge includes a pivot shaft, and a knuckle member unit formed of a stack of knuckle members and pivotally coupled to the pivot shaft. Each knuckle member has a flat mounting base and a shackle that has its one end extended from the flat mounting base and pivotally coupled to the pivot shaft and its other end spaced from the flat mounting base by a gap. The knuckle members are arranged in a stack in such a manner that one of each two adjacent knuckle members has the gap thereof disposed at one lateral side and the other of each two adjacent knuckle members has the gap thereof disposed at an opposing lateral side.

4 Claims, 7 Drawing Sheets

TORQUE-ADJUSTABLE HINGE

BACKGROUND OF THE INVENTION

1. Field of the Invention

The present invention relates to hinges and more particularly, to a torque-adjustable hinge that can easily be designed to provide the desired torque value during forward/backward rotation.

2. Description of the Related Art

Hinges are intensively used in many objects in our daily life. For examples, hinges are commonly used in notebook computers, electronic dictionaries, PDAs and many other electronic devices to connect two solid members, allowing only a limited angle of rotation between them. For use in different products that require different torque values in forward/backward rotation, different hinges shall be used. Preparing hinges having different specifications relatively increases the manufacturing cost.

SUMMARY OF THE INVENTION

The present invention has been accomplished under the circumstances in view. It is the main object of the present invention to provide a hinge consisting of a pivot shaft and a knuckle member unit formed of a stack of knuckle members, which enhances the torque of some knuckle members and reduces the torque of the other knuckle members during rotation of the pivot shaft so that the manufacturer can easily design the knuckle member unit to provide the desired torque value during forward/backward rotation of the pivot shaft.

To achieve this and other objects of the present invention, a hinge comprises a pivot shaft, and a knuckle member unit formed of a stack of knuckle members and pivotally coupled to the pivot shaft. Each knuckle member has a flat mounting base and a shackle that has its one end extended from the flat mounting base and pivotally coupled to the pivot shaft and its other end spaced from the flat mounting base by a gap. The knuckle members are arranged in a stack in such a manner that one of each two adjacent knuckle members has the gap thereof disposed at one lateral side and the other of each two adjacent knuckle members has the gap thereof disposed at an opposing lateral side.

DETAILED DESCRIPTION OF THE PREFERRED EMBODIMENT

Figure 1:
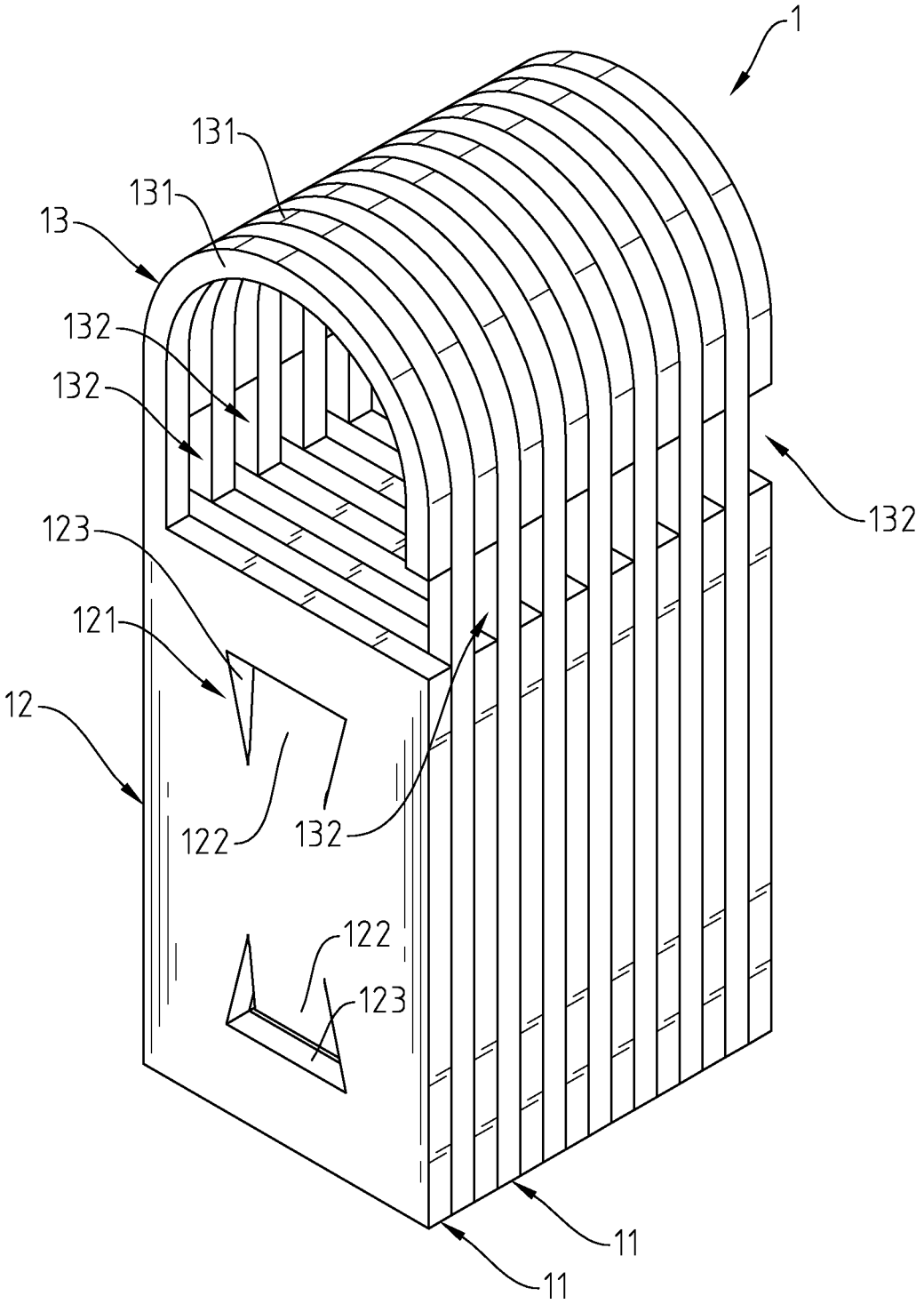
FIG. 1 is an elevational assembly view of a female hinge unit of a hinge in accordance with a first embodiment of the present invention.
Figure 2:
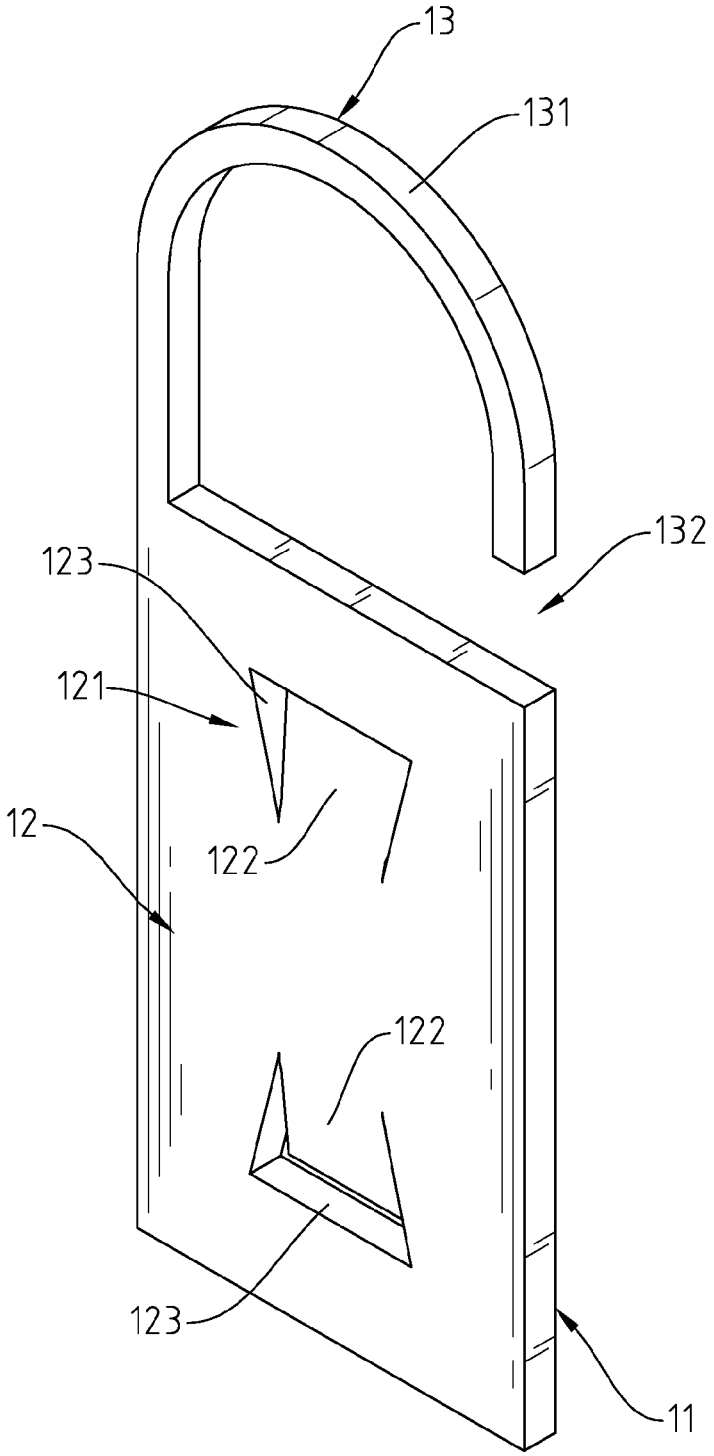
FIG. 2 is an elevational view of one knuckle member of the female hinge unit of the hinge in accordance with the first embodiment of the present invention.

Referring to FIGS. 1 and 2, a hinge in accordance with a first embodiment of the present invention comprises a knuckle member unit 1 and a pivot shaft 2.

The knuckle member unit 1 consists of a plurality of knuckle members 11 arranged in a stack (see FIG. 1). Each knuckle member 11 comprises a flat mounting base 12, at least one, for example, two positioning means 121 located on the flat mounting base 12 and a coupling 13 that comprises an arched shackle 131 extended one end of one peripheral side of the flat mounting base 12 and a gap 132 defined between the free en of the arched shackle 131 and the other end of the respective peripheral side of the flat mounting base 12. Each positioning means 121 comprises a protruding strip 122 formed of a part of the flat mounting base 12 and a crevice 123 cut through the flat mounting base 12 around the protruding strip 122. The crevice 123 is produced when stamping a part of the flat mounting base 12 to form the protruding strip 122. When multiple knuckle members 11 are arranged in a stack to form the knuckle member unit 1, the protruding strips 122 of one knuckle member 11 are respectively engaged into the crevices 123 of another knuckle member 11. Further, each two adjacent knuckle members 11 are reversely abutted against each other, i.e., the gap 132 defined in one knuckle member 11 is disposed at one lateral side while the gap 132 defined in one adjacent knuckle member 11 is disposed at the opposing lateral side.

Figure 3:
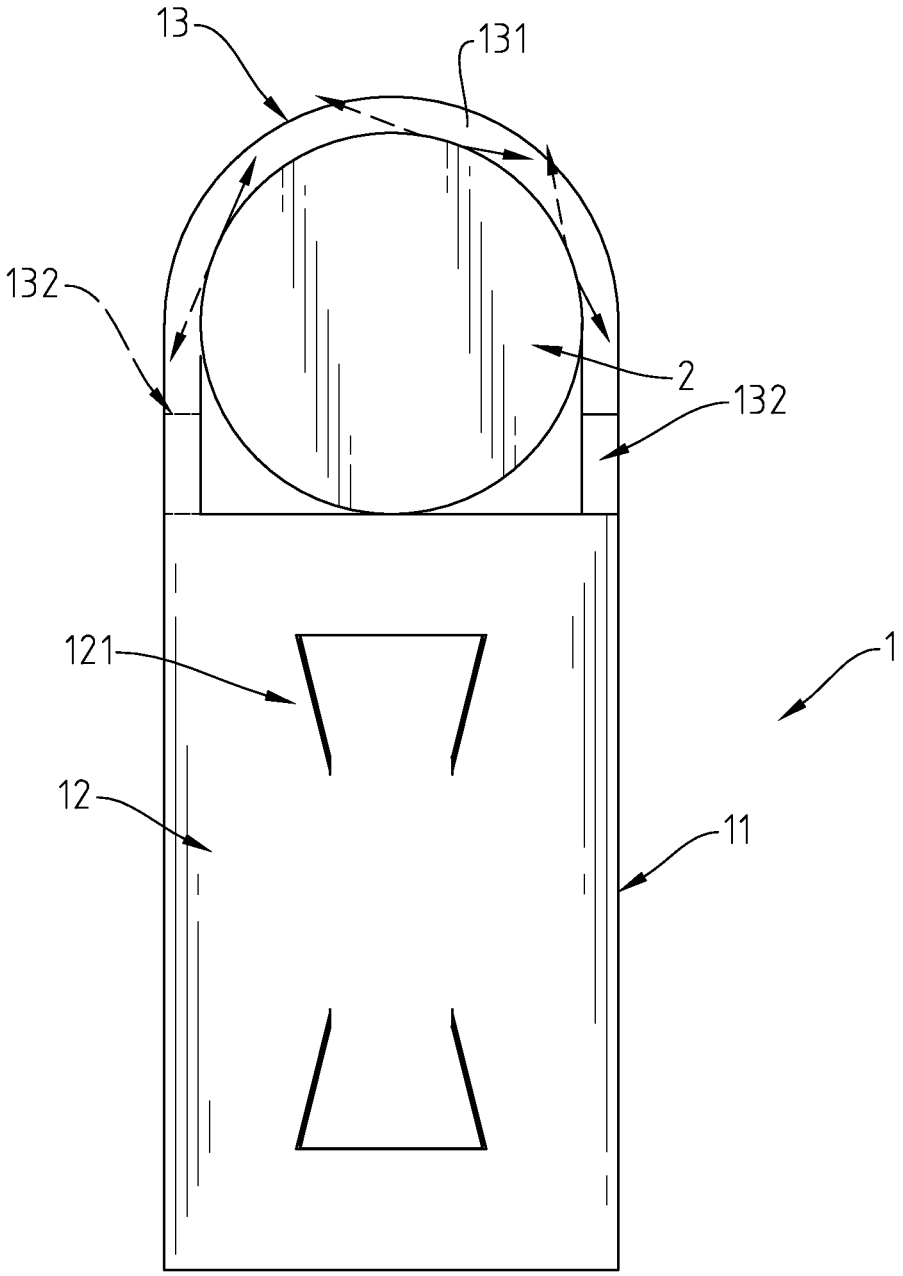
FIG. 3 is a schematic side view showing a status of use of the hinge in accordance with the first embodiment of the present invention.

Referring to FIG. 3 and FIGS. 1 and 2 again, when the pivot shaft 2 is inserted through the coupling portions 13 of the knuckle members 11. As stated above, each two adjacent knuckle members 11 of the knuckle member unit 1 are reversely abutted against each other. When rotating the pivot shaft 2 in one direction relative to the knuckle member unit 1, the pivot shaft 2 will rub against the shackles 131, producing a friction force. Subject to the pressure of the friction force, the shackles 131 of the couplings 13 of which the gaps 132 are located on the respective buckle plates 11 corresponding to the direction of rotation of the pivot shaft 2 are compressed in the tangent direction (see the arrowhead of solid line shown in FIG. 3), enhancing the torque of the respective buckle plates 11; the shackles 131 of the couplings 13 of which the gaps 132 are located on the respective buckle plates 11 reversed to the direction of rotation of the pivot shaft 2 are expanded in the tangent direction (see the arrowhead of imaginary line shown in FIG. 3), reducing the torque of the respective buckle plates 11. Subject to the said characteristics, it is easy to design the knuckle member unit 1 that provides the desired torque value during forward/backward rotation of the pivot shaft 2.

Figure 4:
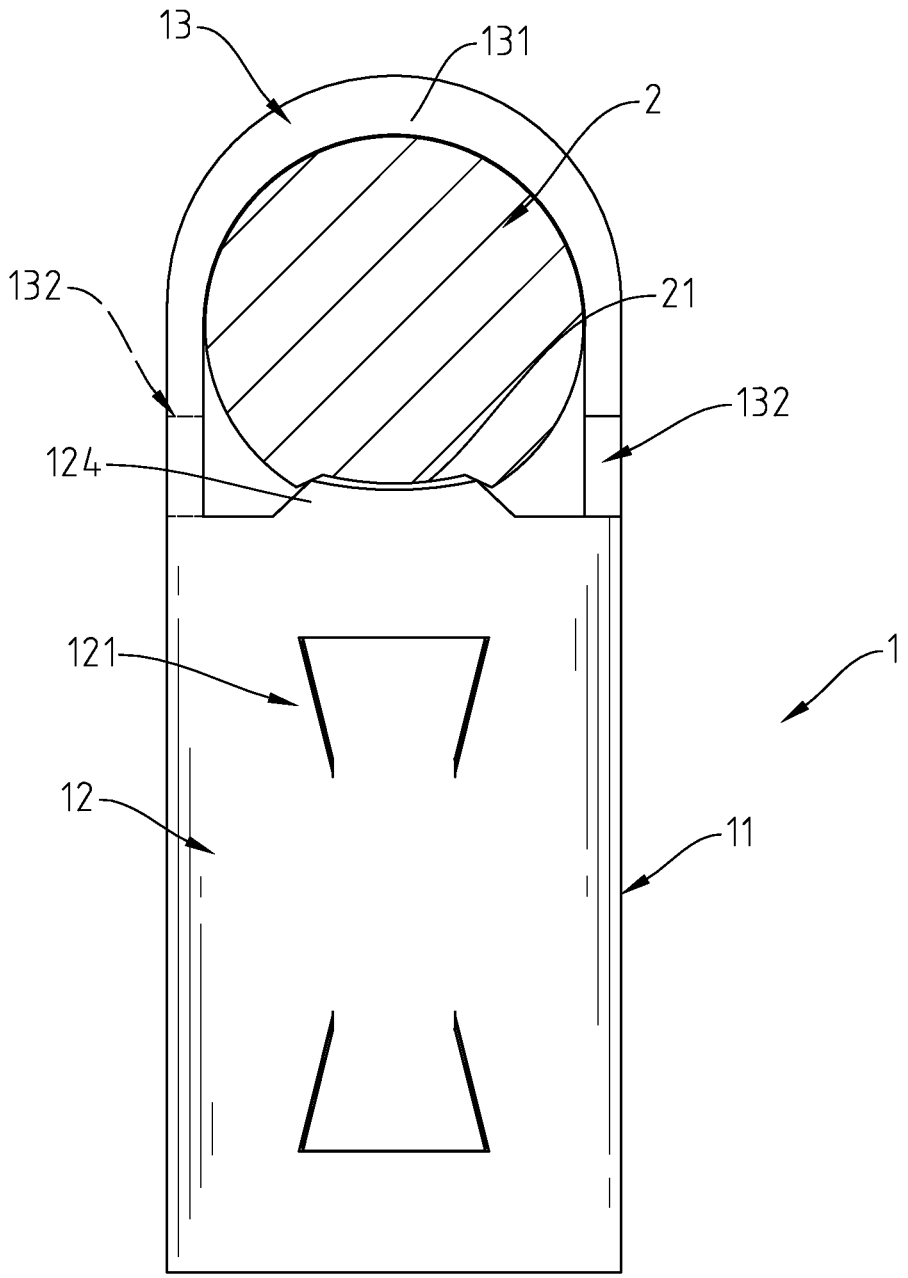
FIG. 4 is a schematic side view of a hinge in accordance with a second embodiment of the present invention.

FIG. 4 is a schematic side view of a hinge in accordance with a second embodiment of the present invention. This second embodiment is substantially similar to the aforesaid first embodiment with the exception that each knuckle member 11 of this second embodiment has a positioning protrusion 124 protruded from one peripheral side of the flat mounting base 12; the pivot shaft 2 of this second embodiment has a positioning groove 21 located on the periphery for engagement with the positioning protrusions 121 of the knuckle members 11.

Figure 5:
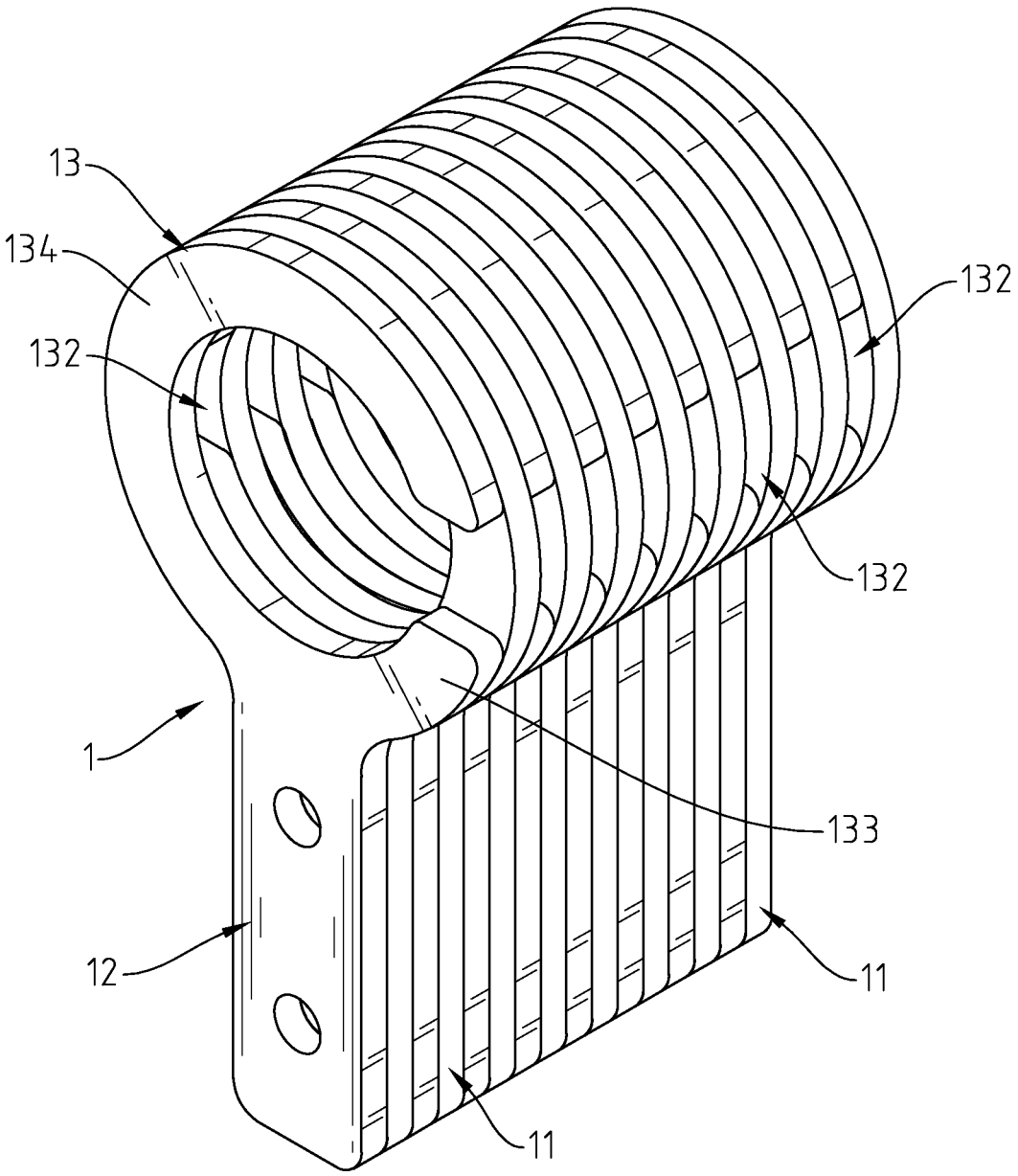
FIG. 5 is an elevational assembly view of a female hinge unit of a hinge in accordance with a third embodiment of the present invention.
Figure 6:
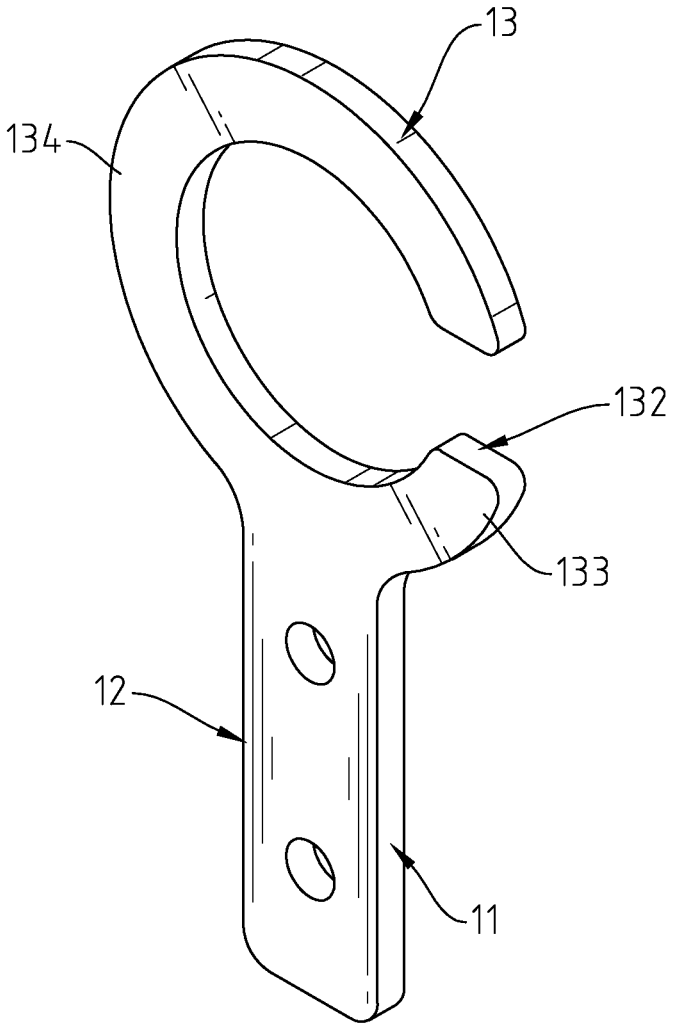
FIG. 6 is an elevational view of one knuckle member of one knuckle member of the female hinge unit of the hinge in accordance with the third embodiment of the present invention.
Figure 7:
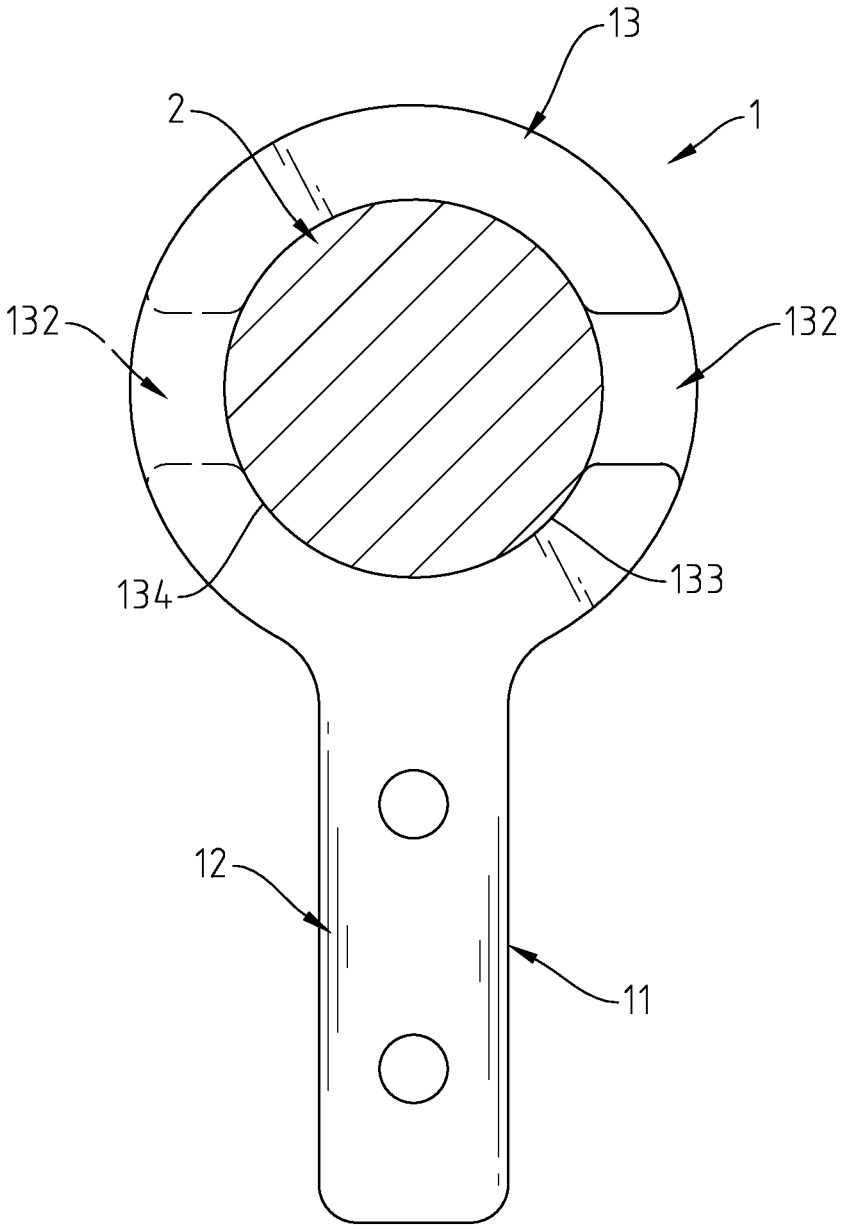
FIG. 7 is a schematic side view showing a status of use of the hinge in accordance with the third embodiment of the present invention.

FIGS. 5~7 show a hinge in accordance with the third embodiment of the present invention. According to this third embodiment, the hinge comprises a knuckle member unit 1 and a pivot shaft 2 inserted through the knuckle member unit 1. The knuckle member unit 1 consists of a plurality of knuckle members 11 arranged in a stack. Each knuckle member 11 comprises a flat mounting base 12 shaped like a flat bar and a coupling 13 that comprises an arched shackle 134 and an arched stub rod 133 extended from one end of the flat mounting base 12 at two sides, and a gap 132 defined between the free end of the arched shackle 134 and the free end of the arched stub rod 133. Further, each two adjacent knuckle members 11 are reversely abutted against each other, i.e., the gap 132 defined in one knuckle member 11 is disposed at one lateral side while the gap 132 defined in one adjacent knuckle member 11 is disposed at the opposing lateral side.

Referring to FIGS. 5~7 again the pivot shaft 2 is inserted through the couplings 13 of the knuckle members 11 of the knuckle member unit 1. As stated above, each two adjacent knuckle members 11 of the knuckle member unit 1 are reversely abutted against each other. When rotating the pivot shaft 2 in one direction relative to the knuckle member unit 1, the pivot shaft 2 will rub against the shackles 134 and the arched stub rod 133, producing a friction force. Subject to the pressure of the friction force, the shackles 134 and arched stub rod 133 of the couplings 13 of which the gaps 132 are located on the respective buckle plates 11 corresponding to the direction of rotation of the pivot shaft 2 are compressed, enhancing the torque of the respective buckle plates 11; the shackles 134 and arched stub rod 133 of the couplings 13 of which the gaps 132 are located on the respective buckle plates 11 reversed to the direction of rotation of the pivot shaft 2 are expanded, reducing the torque of the respective buckle plates 11. Subject to the said characteristics, it is easy to design the knuckle member unit 1 that provides the desired torque during forward/backward rotation of the pivot shaft 2.

Although particular embodiments of the invention have been described in detail for purposes of illustration, various modifications and enhancements may be made without departing from the spirit and scope of the invention.

What the invention claimed is:

1. A hinge, comprising:

a pivot shaft; and a knuckle member unit pivotally coupled to said pivot shaft, said knuckle member unit comprising a plurality of knuckle members arranged in a stack, each said knuckle member comprising a flat mounting base and a coupling extended from said flat mounting base and pivotally connected to said pivot shaft, said coupling defining therein a gap, said knuckle members being arranged in a stack in such a manner that one of each two adjacent knuckle members has the gap thereof disposed at one lateral side and the other of each two adjacent knuckle members has the gap thereof disposed at an opposing lateral side;

wherein each said knuckle member comprises at least one positioning means located on the associated flat mounting base, each said positioning means comprising a protruding strip formed of a part of the associated flat mounting base and a crevice cut through the associating flat mounting base around said protruding strip, the protruding strip of the at least one positioning means of one said knuckle member being engaged into the crevice of the at least one positioning means of another said knuckle member when said knuckle members are arranged in a stack to form said knuckle member unit.

2. The hinge as claimed in claim 1, wherein the coupling of each said knuckle member is formed of an arched shackle that has a fixed end extended from one peripheral side of the associated flat mounting base and a free end thereof spaced from the same peripheral side of the associated flat mounting base by the associated gap.

3. The hinge as claimed in claim 1, wherein the coupling of each said knuckle member comprises an arched shackle and an arched stub rod extended from one end of the associated flat mounting base at two sides; the gap of the coupling of each said knuckle member is defined between the free end of the associated arched shackle and the free end of the associated arched stub rod.

4. The hinge as claimed in claim 1, wherein each said knuckle member comprises a positioning protrusion protruded from one peripheral side of the associating flat mounting base and abutted against the periphery of said pivot shaft.

* * * * *